US009801508B1

(12) United States Patent
Hall et al.

(10) Patent No.: US 9,801,508 B1
(45) Date of Patent: Oct. 31, 2017

(54) HIDDEN HINGE TOILET SEAT AND LID WITH WATER AND ELECTRICAL ACCESS

(71) Applicants: David R. Hall, Provo, UT (US); Dan Allen, Springville, UT (US); Jared Reynolds, Pleasant Grove, UT (US); Joshua Larsen, Spanish Fork, UT (US); Terrece Pearman, Draper, UT (US)

(72) Inventors: David R. Hall, Provo, UT (US); Dan Allen, Springville, UT (US); Jared Reynolds, Pleasant Grove, UT (US); Joshua Larsen, Spanish Fork, UT (US); Terrece Pearman, Draper, UT (US)

( * ) Notice: Subject to any disclaimer, the term of this patent is extended or adjusted under 35 U.S.C. 154(b) by 0 days.

(21) Appl. No.: 15/293,753

(22) Filed: Oct. 14, 2016

(51) Int. Cl.
*A47K 13/12* (2006.01)
*A47K 13/10* (2006.01)
*A47K 13/24* (2006.01)

(52) U.S. Cl.
CPC ..... *A47K 13/12* (2013.01); *A47K 13/10* (2013.01); *A47K 13/24* (2013.01)

(58) Field of Classification Search
CPC ..... A47K 13/20; A47K 13/12; A47K 13/24
USPC ..... 4/236
See application file for complete search history.

(56) References Cited

U.S. PATENT DOCUMENTS 550,416 A * 11/1895 Madden ..... A47K 13/12 4/236
1,999,905 A * 4/1935 Helfrich ..... E03D 11/13 4/236
2009/0064402 A1* 3/2009 Mauduit ..... A47K 13/12 4/236

* cited by examiner

*Primary Examiner* — Huyen Le

(57) ABSTRACT

A hidden hinge system for raising and lowering a toilet seat or toilet lid is disclosed. In one embodiment, each hinge includes a curved support with a smooth, easy to clean surface. The curved support is connected to a lever and the lever is connected to a hinge assembly. We disclose embodiments in which both the lever and the hinge assembly are enclosed within a toilet housing to improve cleanliness. We further disclose embodiments in which the curved supports are hollow and which contain electrical wiring, water, and gases. Controller and proximity sensors which modulate the raising and lowering of the toilet seat and toilet lid are also disclosed and claimed herein.

20 Claims, 7 Drawing Sheets

HIDDEN HINGE TOILET SEAT AND LID WITH WATER AND ELECTRICAL ACCESS

BACKGROUND

Field of the Invention

This invention relates to hinge systems for lifting and lowering toilet lids and toilet seats.

Background of the Invention

Conventional toilets seats and lids have exposed hinges which rotate around an exposed hinge point. This design presents challenges for cleaning and aesthetics. The exposed hinges provide surfaces and orifices which are easy targets for bacterial growth, accumulation of dirt, hair, and dust, and frequent staining. Urine or toilet water may be splashed or sprayed on the exposed hinges between cleanings.

One need is to move the hinges on toilet seats and lids to a location where they are not splashed by water or urine, leaving the exposed surfaces flat and smooth. Such a design would be easy to clean, rather the conventional design which requires cleaning in, around, and under various points of the hinge system.

Furthermore, more advanced toilets include more complex plumbing and electrical systems that power features beyond simple waste removal. A hinge system with a cavity for housing electrical wiring and/or transporting water and gases is needed.

Ideally, such improvements in toilet seat hinges and lid hinges would increase toilet cleanliness, reduce cleaning frequency, and provide a protected cavity in which to install wiring and tubing for use in more advanced features.

SUMMARY

This invention has been developed in response to the present state of the art and, in particular, in response to the problems and needs in the art that have not yet been fully solved by currently available systems. Accordingly, an improved toilet hinge system has been developed. Features and advantages of different embodiments of the invention will become more fully apparent from the following description and appended claims, or may be learned by practice of the invention as set forth hereinafter.

Consistent with the foregoing, a hidden hinge system for use on a toilet seat or lid is disclosed and claimed herein. The hinge system includes a curved support, which has a smooth surface, and which is exposed when the toilet seat or lid is raised. The curved support rotates into the toilet body as the seat or lid is lowered. The curved support is connected to a lever and the lever is connected to a hinge assembly. The lever and hinge assembly are located within the toilet body.

We further disclose embodiments of the invention in which the curved support may be hollow. The hollow interior of the curved support may contain electrical wiring, water, and/or gases. The water or gases may be transported through the hollow interiors to other parts of the toilet to perform functions that include cleaning or drying.

We further disclose embodiments of the invention in which controllers direct the raising and lowering of the toilet seat and/or lid. Embodiments in which the controllers respond to proximity sensors to raise or lower the toilet seat or lid when a user approaches are further disclosed and claimed.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
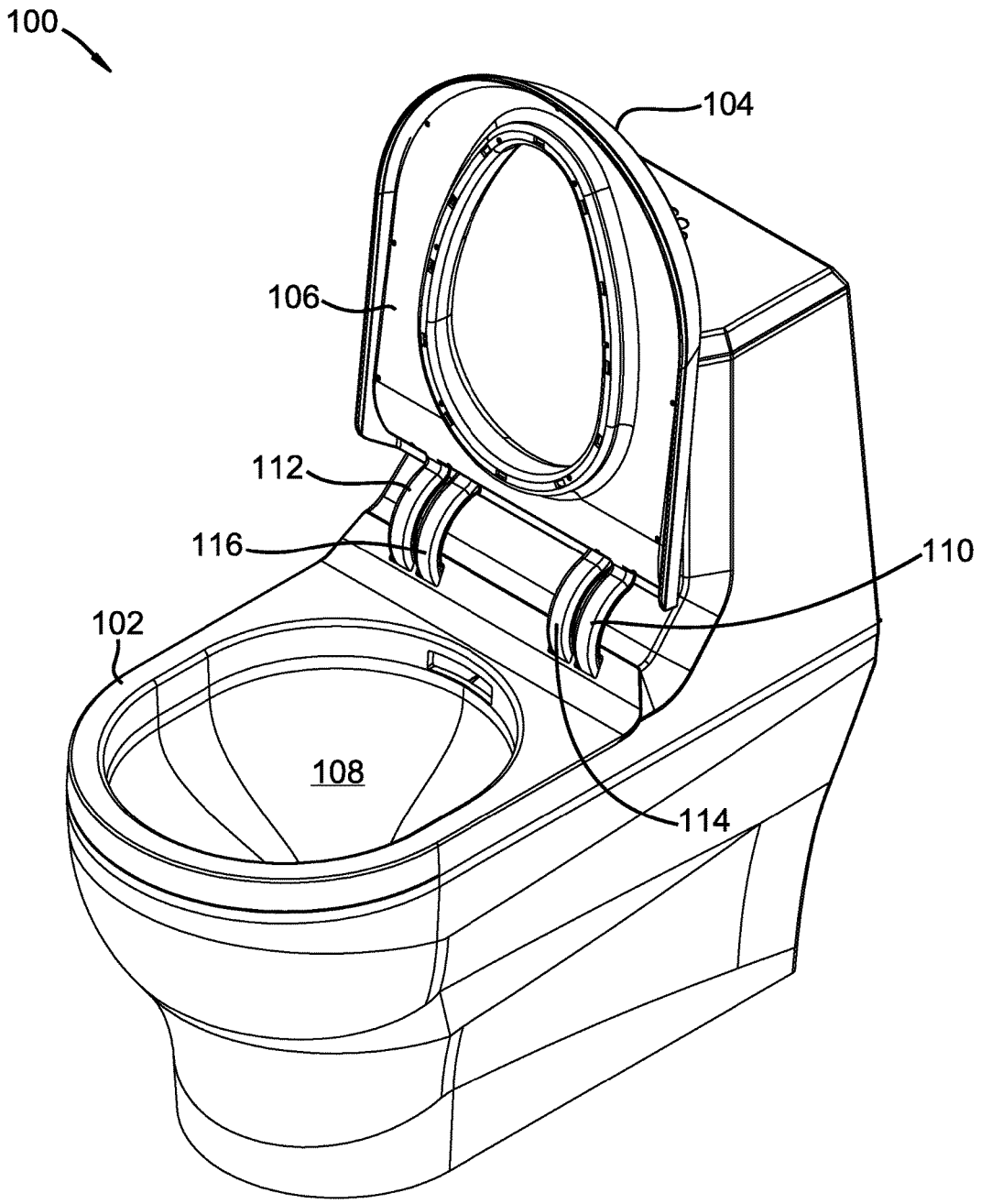
FIG. 1 shows a perspective view of a toilet in which both the toilet seat and lid are raised and lowered on hidden hinge systems according to an embodiment of the invention.

Referring to FIG. 1, toilet 100 according to an embodiment of the invention is shown. Toilet 100 comprises rim 102, lid 104, seat 106, and bowl 108. Seat 106 is connected to curved supports 110 and 112. Lid 104 is connected to curved supports 114 and 116. Curved supports 110, 112, 114, and 116 have approximately smooth surfaces for ease of cleaning. As described in more detail elsewhere herein, curved supports 110, 112, 114, and 116 rotate downward and into openings in the housing of toilet 100 when seat 106 and lid 104 are lowered. When located within the toilet housing, curved supports 110, 112, 114, and 116 are further protected from exposure to dirt, hair, and dust. As one of skill in the art will recognize, other embodiments of toilets may comprise of only one or the other of the hinge systems shown in FIG. 1. For example, an embodiment of a toilet may comprise curved supports 110 and 112 but not curved supports 114 and 116. Alternatively, an embodiment of a toilet may comprise of curved supports 114 and 116 but not curved supports 110 and 112.

Figure 2:
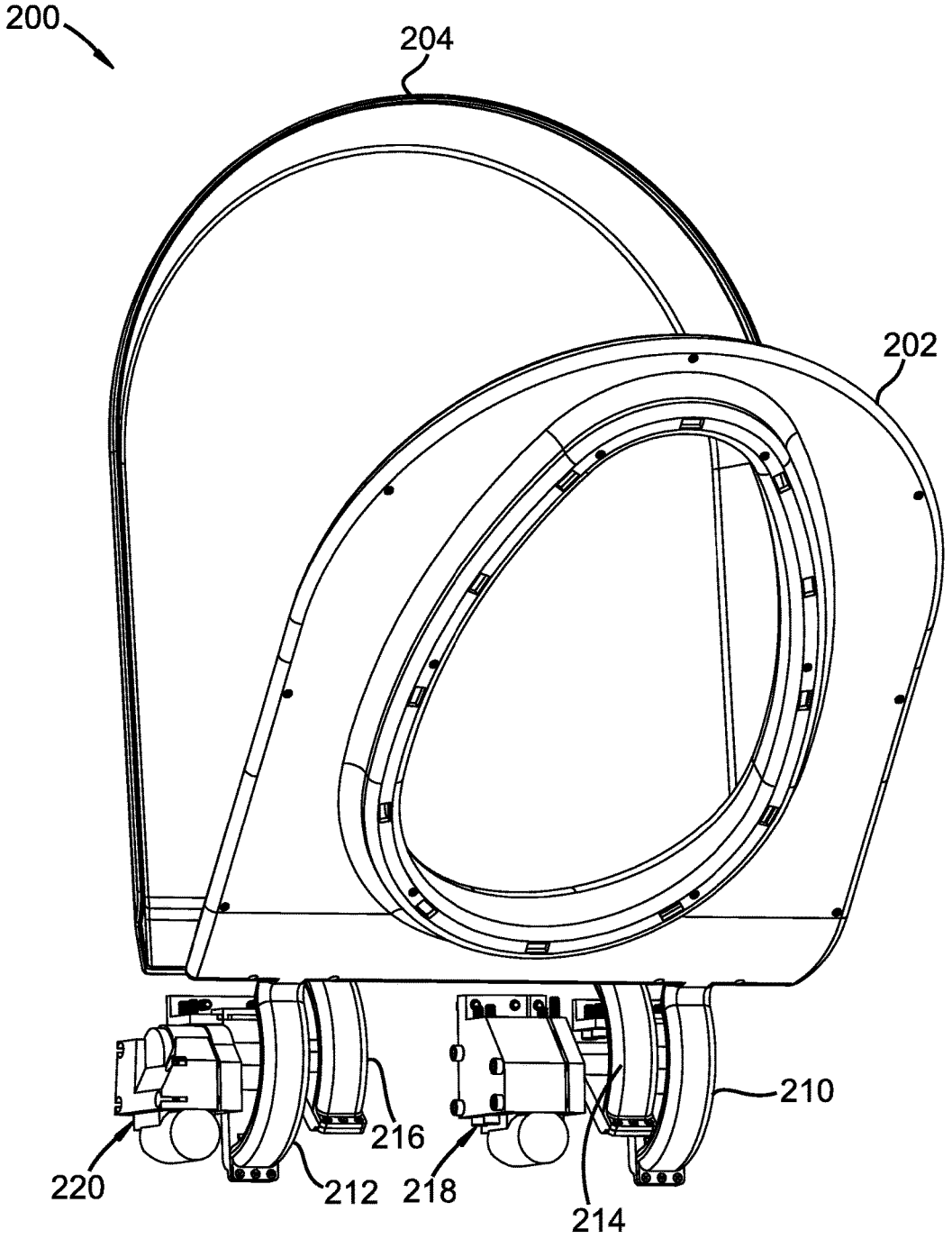
FIG. 2 shows a perspective view of a toilet seat and toilet lid, each in connection with an embodiment of the hidden hinge system.

FIG. 2 shows toilet seat assembly 200 with seat 202 and lid 204. Seat 202 comprises first curved support 210 and second curved support 212 at its base, first curved support 210 being hingedly attached to first hinge assembly 218, and second curved support 212 being hingedly attached to second hinge assembly 220. In some embodiments, the curved supports are connected to the hinge assemblies by means of levers that are positioned between the curved support and a hinge assembly as described in more detail elsewhere herein.

Toilet seat assembly 200 also comprises lid 204 which comprises third curved support 214 and fourth curved support 216, the third curved support 214 being attached to the first hinge assembly 218 and the fourth curved support 216 being attached to the second hinge assembly 220. First curved support 210 and second curved support 212 each comprise a hollow interior cavity through which water tubes, gas tubes, or electrical wires may be passed into seat 202. Third curved support 214 and fourth curved support 216 also each comprise a hollow interior cavity through which water tubes, gas tubes, or electrical wires may be passed into lid 204. Other embodiments of the invention may comprise of solid curved supports which do not provide a hollow interior cavity.

First hinge assembly 218 and second hinge assembly 220 may comprise motors so that the movement of seat 202 and the lid 204 is motorized. The motorized seat 202 and lid 204 would be particularly helpful to toilet users with a medical condition that prevents them from easily reaching, moving, or lifting objects. The use of motors also gives the toilet seat assembly 200 a capacity for autonomous function. For example, the motors may be controlled by a controller, which comprises a processor and a memory unit. The processor may also be connected to seat sensors such as strain gauges or pressure transducers in seat 202. The processor may also be connected to proximity sensors in seat 202 or in lid 204. The processor may also be connected seat sensors that measure displacement of water in the toilet bowl. Using these sensors, the processor may determine that a user is sitting on seat 202, or otherwise using the toilet by monitoring connected sensors. When a user is detected to have finished using the toilet and is also detected to no longer be sitting on the toilet, the processor may use the controller to automatically close lid 204 and perform a toilet flush. The processor may also monitor sensors to determine when a user intends to urinate into the toilet from a standing position and automatically lift seat 202 using motors in first hinge assembly 218 and second hinge assembly 220.

Figure 3A:
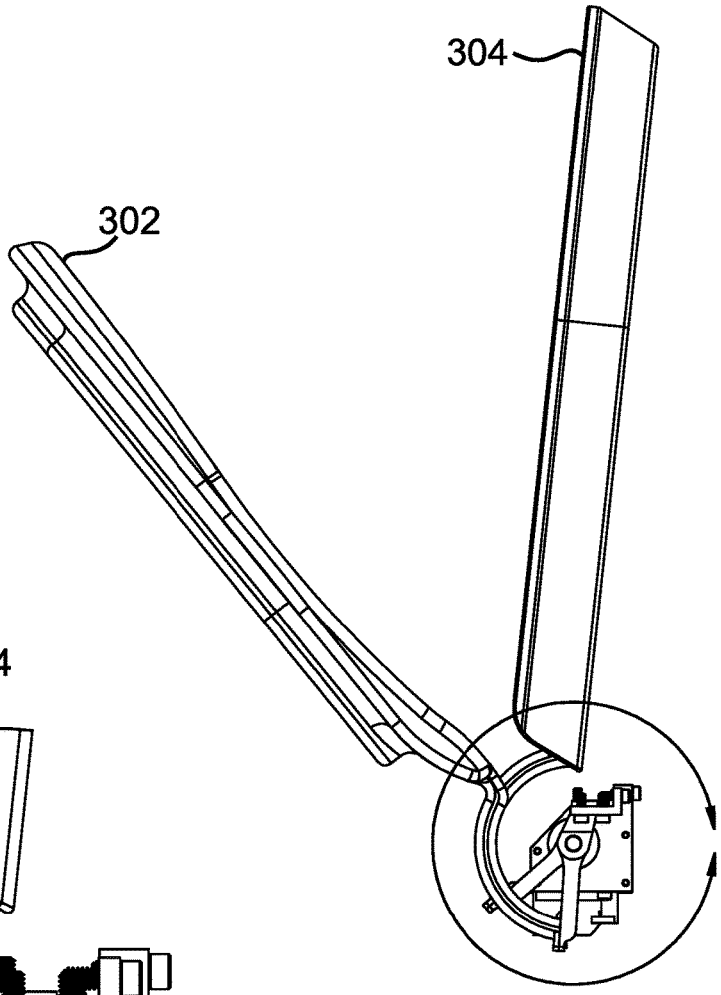
FIGS. 3A and 3B show a side view and close-up side view respectively of a toilet seat and lid attached to a hinge system according to an embodiment of the invention.
Figure 3B:
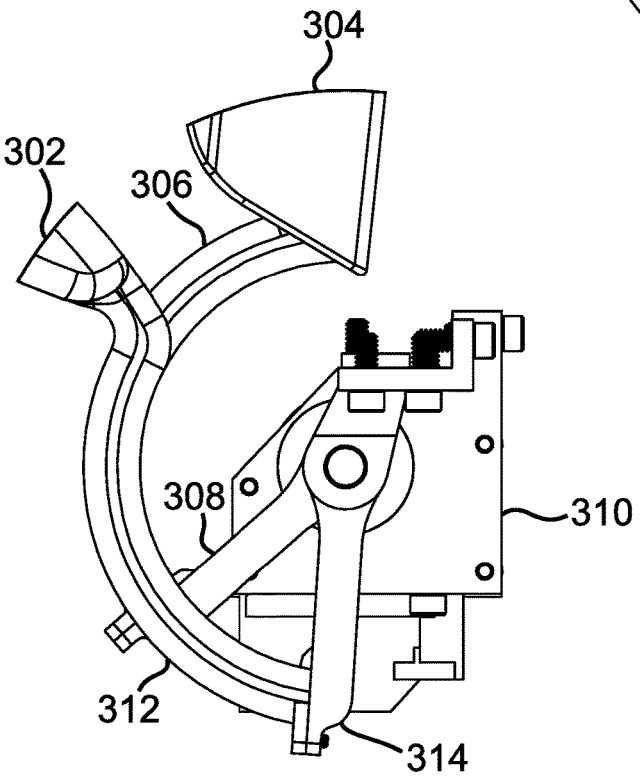

FIG. 3A shows a side view of a toilet seat assembly comprising seat 302 in a partially open position and lid 304 in a lifted or open position. FIG. 3B shows a close up view of the same side view shown in FIG. 3A. Seat 302 is shown connected to curved support 312, the latter of which is attached to first lever 314. Lid 304 is shown having curved support 306, the latter of which is attached to second lever 308. First lever 314 and second lever 308 are pivotally attached to a hinge assembly 310. Hinge assembly 310 may be fixedly attached to a toilet body so that seat 302 and lid 304 are attached to the toilet. The hinge assembly may comprise a motor so that seat 302 and lid 304 can be controlled automatically by a processor in a manner described previously. First lever 314 and second lever 308 provide attachment points to curved support 312 and curved support 306 respectively and allow movement of seat 302 and lid 304 to occur at an offset distance away from the axis of rotation of hinge assembly 310.

Figure 4A:
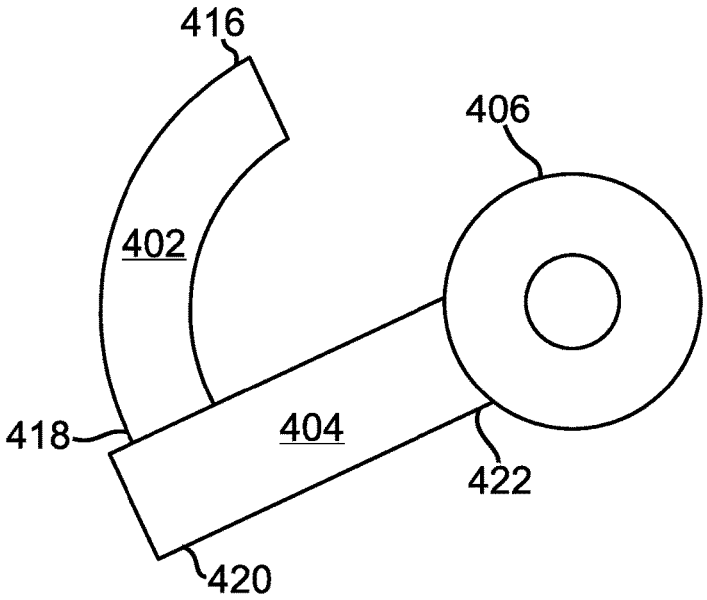
FIG. 4A shows a side view of an embodiment of the hinge system with a curved support and a lever.

FIG. 4A shows a simplified hinge system separated from the seat or lid and from the hinge assembly. FIG. 4A is provided to show a part of a single hinge system that pertains only to the lifting of either a seat or lid. The hinge assembly is removed for clarity. FIG. 4A illustrates curved support 402 which includes first end 416 and second end 418. FIG. 4A further shows first lever 404 which includes first end 420 and second end 422. Second end 418 of curved support 402 is connected to first end 420 of lever 404. Second end 422 of first lever 404 is connected to axis of rotation 406. Axis of rotation 406 is provided to show how first lever 404 rotates as well as second lever 408 which is not shown in this drawing.

Figure 4B:
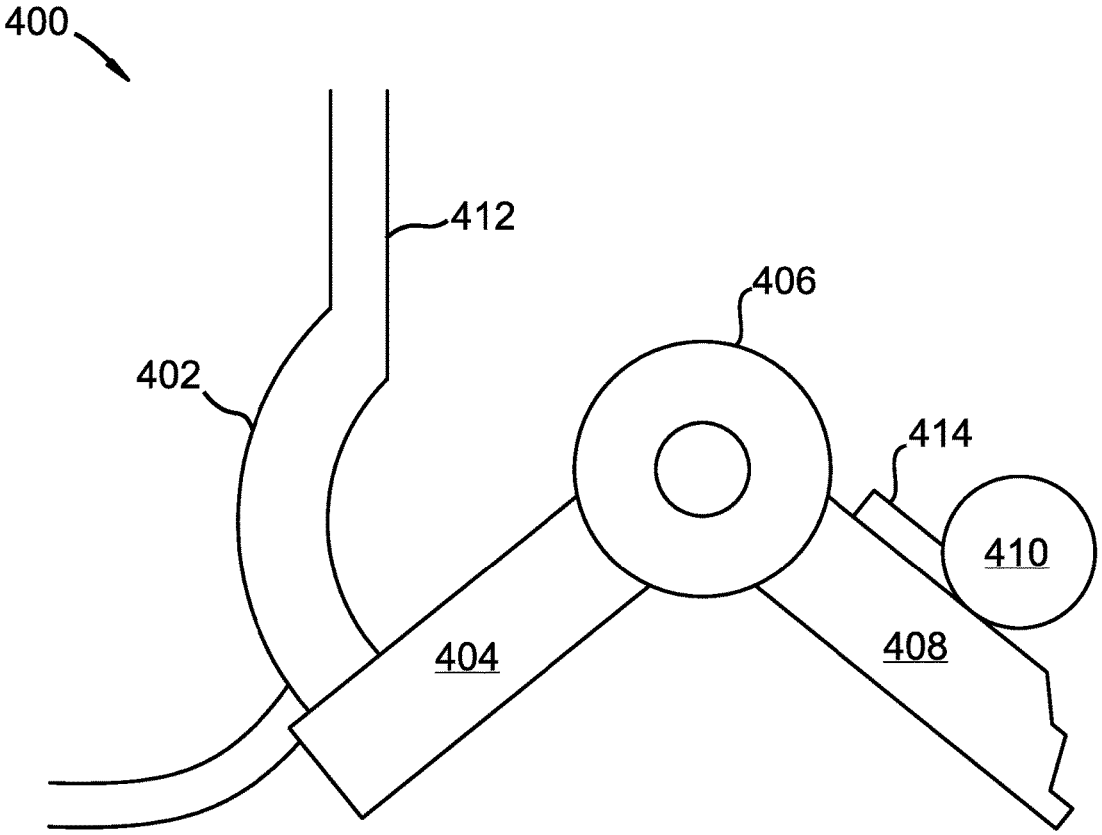
FIG. 4B shows a side view of the hinge of FIG. 4A with a lever attached to a hinge assembly according to an embodiment of the invention.

FIG. 4B shows a hinge system 400 which includes the components shown in FIG. 4A as well as additional components to create a second hidden hinge system. Hinge system 400 includes curved support 402 which is connected to seat 412. Second lever 408 is also included in FIG. 4B and is the lever to which a second curved support would be attached. For simplicity, the second curved support is not shown but it is attached to a toilet lid in a manner similar to that in which curved support 402 is attached to seat 412. Like first lever 404, second lever 408 is pivotally attached to axis of rotation 406.

Figure 4C:
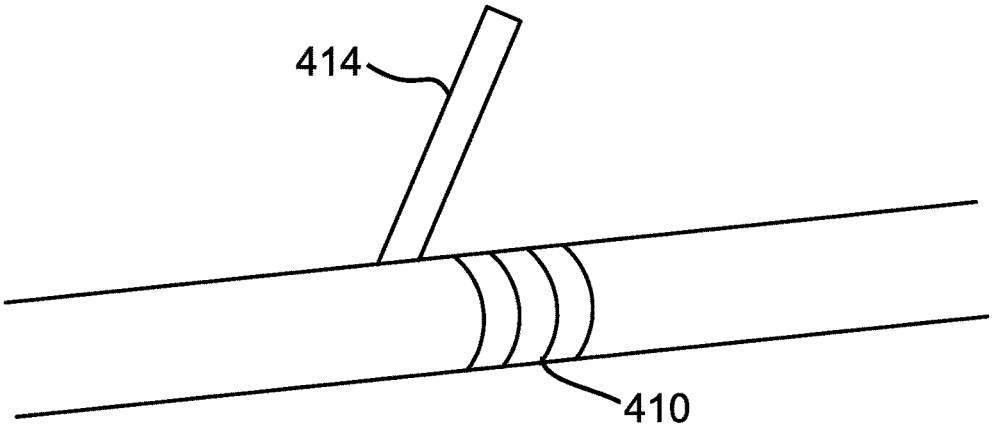
FIG. 4C shows a spring assembly according to an embodiment of the invention.

FIG. 4B further shows a spring assembly. The spring assembly includes coiled section 410 and extension 414. Extension 414 is positioned against second lever 408, although in some embodiments, a second spring assembly may be positioned against first lever 404. The resistance from the spring assembly pushes against second lever 408. The resistance is transmitted through the hinge system to oppose the movement of the curved support. The motor or manual force which is applied to lift the lid must overcome the resistance to fully lift the lid. Consequently, the lid does not fly up too quickly in the process of lifting because the resistance slows the movement. FIG. 4C shows the spring assemble close up. FIG. 4C shows coiled section 410 wrapped around a support rod. Extension 414 is shown as a continuation of coiled section 410.

Figure 4D:
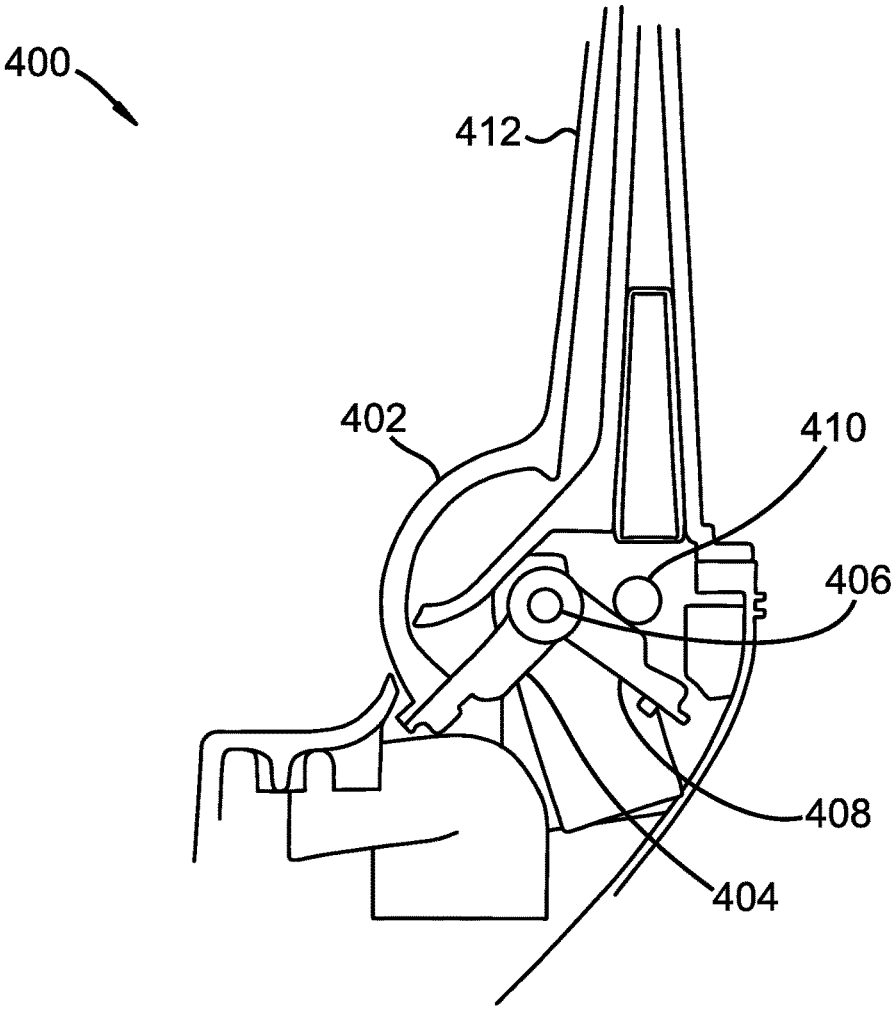
FIG. 4D shows a cross-sectional view of a toilet with the hidden hinge system according to an embodiment of the invention.

FIG. 4D is a side view of the hinge system shown in FIG. 4B which is installed in a toilet. A first end of curved support 402 is attached to seat 412. A second end of curved support 402 is attached to first lever 404. Second lever 408 is shown and a curved support which would be attached to second lever 408 is omitted for clarity. Both first lever 404 and second lever 408 rotate around axis of rotation 406. Spring support 410 is shown in contact with second lever 408.

Figure 4E:
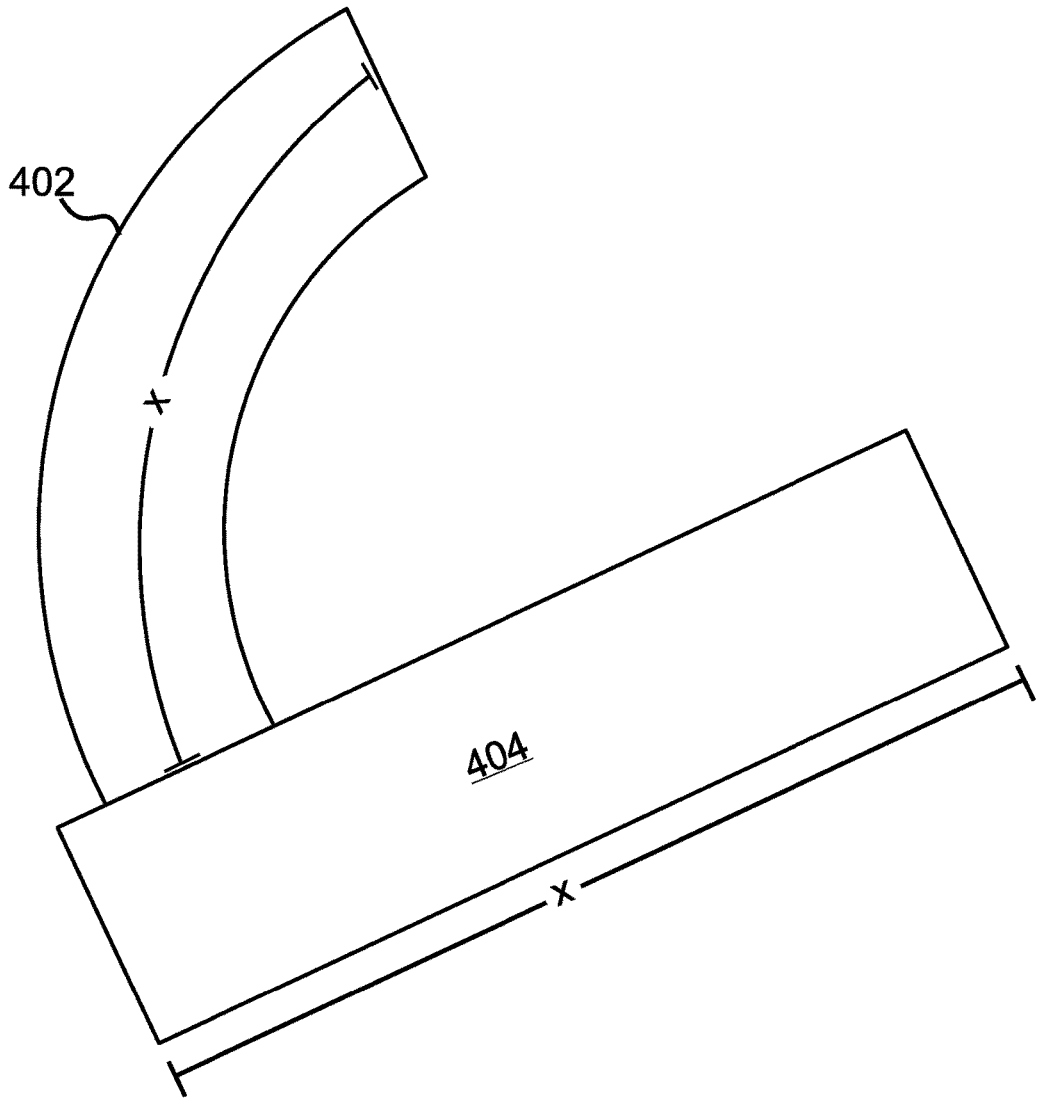
FIG. 4E shows the relative dimensions of a curved support and a lever according to an embodiment of the invention.

FIG. 4E illustrates an embodiment in which the relative lengths of curved support 402 and first lever 404 are shown. In some embodiments, the length of first lever 404, depicted as "x" in FIG. 4E, is approximately equal to the distance along curved support 402 from first end 416 to second end 418, also depicted as "x" in FIG. 4E. First end 416 and second end 418 of curved support 402 are defined in FIG. 4A. In other embodiments, the length of first lever 404 is within 20% of the distance along curved support 402 from first end 416 to second end 418.

Figure 5A:
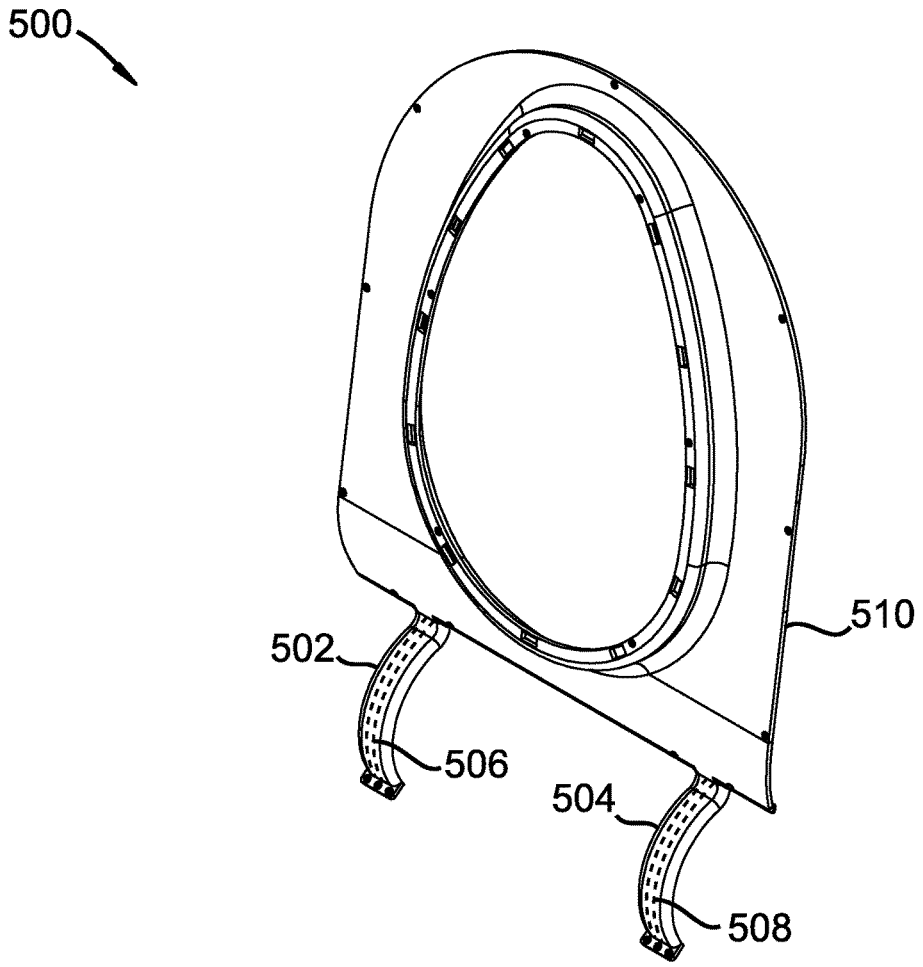
FIG. 5A shows a toilet seat with curved supports that include hollow interiors according to an embodiment of the invention.
Figure 5B:
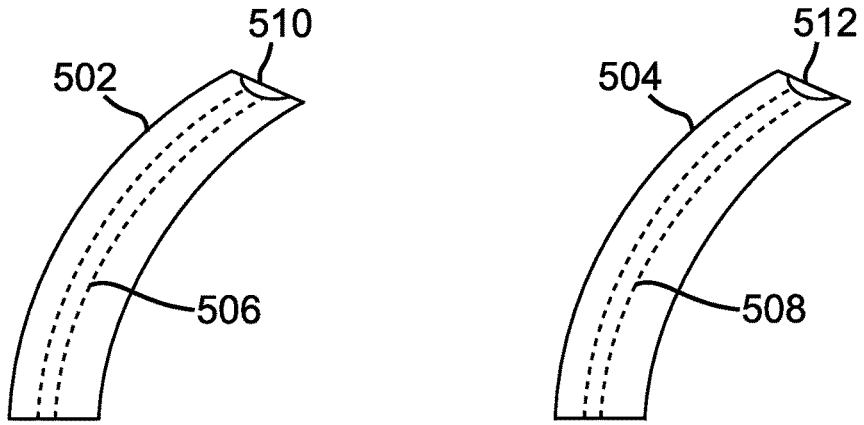
FIG. 5B shows the curved supports of FIG. 5A.

FIGS. 5A and 5B illustrate embodiments of the curved supports in which the curved supports include a hollow interior cavity. FIG. 5A illustrates toilet seat assembly 500 which includes seat 510. Seat 510 is attached to curved supports 502 and 504. The dashed lines indicate hollow interior cavity 506 within curved support 502 and hollow interior cavity 508 within curved support 504.

FIG. 5B is a close up of curved supports 502 and 504, each including hollow interior cavity 506 and 508 respectively. Curved support 502 also includes opening 510 while curved support 504 includes opening 512. Electrical wiring, tubes for transporting water, or tubes for transporting gases may be inserted through openings 510 and 512 and continue through hollow interior cavities 506 and 508. In some embodiments, hollow interior cavities 506 and 508 may function as the tubes for transporting water or gases such that additional tubing is not needed.

The electrical wires may be connected to sensors used to detect the presence of a toilet user, such as proximity sensors, strain gauges, infrared sensors, or range finding sensors. Detection and bio sensors may be used such that a processing unit is capable of detecting when a user is sitting on the toilet and may automatically lower the toilet lid and flush the toilet upon a user removing his/herself from the toilet seat. The sensors may also be used such that a processing unit is capable of detecting when a user is approaching a toilet and the processor may raise the toilet lid in response as a means of preparing the toilet for use by the user. The sensors may also be used to detect when a user is preparing to urinate into the toilet while standing, and the processor may lift both the toilet lid and toilet seat in preparation. The seat sensors and bio sensors may be connected to a processor and a memory unit such that the processor can receive, save, and recall bio sensor data in order to identify a user whose bio data is saved in the memory unit.

The apparatuses disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A toilet comprising a hinge system for lifting and lowering a toilet seat, the toilet comprising:
- a liftable toilet seat;
- a toilet body;
- a hinge system, the hinge system comprising:
  - a curved support, the curved support comprising:
    - a first and second end,
      - wherein the first end is attached to the toilet seat, and
      - wherein the curved support rotates and enters the toilet body through an opening in the toilet body as the toilet seat is lowered, and;
  - a lever,
    - wherein the lever comprises a first end and a second end;
    - wherein the first end of the lever is attached to the second end of the curved support, and
    - wherein the lever is located within the toilet body;
  - a hinge assembly;
    - wherein the hinge assembly is pivotally attached to the second end of the lever, and
    - wherein the hinge assembly is fixedly attached to a point within the toilet body.

2. The toilet of claim 1, wherein the toilet comprises two hinge systems.

3. The toilet of claim 1, wherein a gasket surrounds the opening in the toilet body, wherein the gasket comprises a lip, and wherein the lip scrapes the curved support as the curved support enters the toilet body, thereby scraping debris from the curved support.

4. The toilet of claim 1, wherein the curved support further comprises at least one hollow interior cavity.

5. The toilet of claim 4, wherein the at least one hollow interior cavity comprises one or more of the following:
- electrical wiring, tubing for transporting water, and tubing for transporting gas.

6. The hinge system of claim 1, wherein one or more of the toilet seat, the gasket, and the curved support comprise of a bacterial resistant material.

7. The toilet of claim 1, further comprising a motor, wherein the motor provides power to lift and to lower the toilet seat.

8. The toilet of claim 7, wherein the motor is controlled by a controller, and wherein the controller comprises a processor and a memory unit.

9. The toilet of claim 8, wherein the processor is connected to at least one proximity sensor;
- wherein the at least one proximity sensor detects when a user approaches the toilet and the processor sends a signal which automatically lifts the toilet seat, and;
- wherein the at least one proximity sensor detects when the user steps away from the toilet and automatically lowers the toilet seat.

10. The toilet of claim 1, a spring assist member, the spring assist member comprising:
- a helical spring, wherein the helical spring comprises:
  - a coiled section; and
  - an extension;
    - wherein the extension is connected to and extends from an end of the coiled section;
    - wherein the extension is in contact with the lever; and
    - wherein the spring assist member provides resistance against the lever, thereby controlling the lifting and lowering of the toilet seat by controlling the motion of the lever.

11. A toilet comprising a hinge system for lifting and lowering a toilet lid, the toilet comprising:
- a liftable toilet lid;
- a toilet body;
- a hinge system, the hinge system comprising:
  - a curved support, the curved support comprising:
    - a first and second end,
      - wherein the first end is attached to the toilet lid, and
      - wherein the curved support rotates and enters the toilet body through an opening in the toilet body as the toilet lid is lowered, and;
  - a lever,
    - wherein the lever comprises a first end and a second end;
    - wherein the first end of the lever is attached to the second end of the curved support, and
    - wherein the lever is located within the toilet body;
  - a hinge assembly;
    - wherein the hinge assembly is pivotally attached to the second end of the lever, and
    - wherein the hinge assembly is fixedly attached to a point within the toilet body.

12. The toilet of claim 11, wherein the toilet comprises two hinge systems.

13. The toilet of claim 11, wherein a gasket surrounds the opening in the toilet body, wherein the gasket comprises a lip, and wherein the lip scrapes curved support the curved support enters the toilet body, thereby scraping debris from the curved support.

14. The toilet of claim 11, wherein the curved support further comprises at least one hollow interior cavity.

15. The toilet of claim 14, wherein the at least one hollow interior cavity comprises one or more of the following:

electrical wiring, tubing for transporting water, and tubing for transporting gas.

16. The hinge system of claim 11, wherein one or more of the toilet lid, the gasket, and the curved support comprise of a bacterial resistant material.

17. The toilet of claim 11, further comprising a motor, wherein the motor provides power to lift and to lower the toilet lid.

18. The toilet of claim 17, wherein the motor is controlled by a controller, and wherein the controller comprises a processor and a memory unit.

19. The toilet of claim 18, wherein the processor is connected to at least one proximity sensor;

wherein the at least one proximity sensor detects when a user approaches the toilet and the processor sends a signal which automatically lifts the toilet lid, and;

wherein the at least one proximity sensor detects when the user steps away from the toilet and automatically lowers the toilet lid.

20. The toilet of claim 11, a spring assist member, the spring assist member comprising:

a helical spring, wherein the helical spring comprises:

a coiled section; and an extension;

wherein the extension is connected to and extends from an end of the coiled section;

wherein the extension is in contact with the lever; and wherein the spring assist member provides resistance against the lever, thereby controlling the lifting and lowering of the toilet lid by controlling the motion of the lever.

* * * * *